US011308860B2

(12) United States Patent
Cong et al.

(10) Patent No.: US 11,308,860 B2
(45) Date of Patent: Apr. 19, 2022

(54) PIXEL CIRCUIT AND DRIVING METHOD, PIXEL UNIT, DISPLAY PANEL

(71) Applicant: BOE Technology Group Co., Ltd., Beijing (CN)

(72) Inventors: Ning Cong, Beijing (CN); Minghua Xuan, Beijing (CN); Han Yue, Beijing (CN); Ming Yang, Beijing (CN); Xiaochuan Chen, Beijing (CN); Detao Zhao, Beijing (CN); Liang Chen, Beijing (CN); Can Zhang, Beijing (CN); Can Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 383 days.

(21) Appl. No.: 16/605,932

(22) PCT Filed: May 10, 2019

(86) PCT No.: PCT/CN2019/086425

§ 371 (c)(1),
(2) Date: Oct. 17, 2019

(87) PCT Pub. No.: WO2020/007122

PCT Pub. Date: Jan. 9, 2020

(65) Prior Publication Data

US 2021/0335212 A1 Oct. 28, 2021

(30) Foreign Application Priority Data

Jul. 4, 2018 (CN) ..... 201810725147.5

(51) Int. Cl.
*G09G 3/32* (2016.01)

(52) U.S. Cl.
CPC ..... *G09G 3/32* (2013.01); *G09G 2300/0857* (2013.01); *G09G 2310/0267* (2013.01)

(58) Field of Classification Search
CPC ..... G09G 3/32; G09G 2300/0857; G09G 2310/0267
See application file for complete search history.

(56) References Cited

U.S. PATENT DOCUMENTS 5,712,652 A * 1/1998 Sato ..... G09G 3/3648 345/90
10,867,548 B2 * 12/2020 Kuo ..... G09G 3/32
(Continued)

*Primary Examiner* — Christopher E Leiby
(74) *Attorney, Agent, or Firm* — Intellectual Valley Law, P.C.

(57) ABSTRACT

The present application discloses a pixel circuit and its driving method. The pixel circuit includes an input circuit, a control circuit, and $2^N$ output circuits with N being a positive integer. The input circuit is configured to control a voltage level of a respective one of N control nodes under control of a gate-driving signal from each gate line and a first control signal. The control circuit is configured to respectively control a voltage level of each of $2^N$ switching nodes under control of the N control nodes. The $2^N$ output circuits are respectively connected to $2^N$ data-signal terminals and the $2^N$ switching nodes. Among the $2^N$ output circuits, an i-th output circuit is configured to input an i-th data signal from an i-th data-signal terminal of the $2^N$ data-signal terminals to an emission circuit under control of an i-th switching node of the $2^N$ switching nodes.

19 Claims, 10 Drawing Sheets

(56) References Cited

U.S. PATENT DOCUMENTS

| | | | | |
|---|---|---|---|---|
| 10,909,926 | B2 * | 2/2021 | Lin | G09G 3/32 |
| 2001/0005193 | A1 * | 6/2001 | Yokoyama | G09G 3/3648 345/92 |
| 2002/0030670 | A1 * | 3/2002 | Matsueda | G09G 3/2014 345/204 |
| 2006/0164360 | A1 * | 7/2006 | Wakabayashi | G09G 3/3266 345/94 |
| 2019/0347994 | A1 * | 11/2019 | Lin | G09G 3/32 |

* cited by examiner

PIXEL CIRCUIT AND DRIVING METHOD, PIXEL UNIT, DISPLAY PANEL

CROSS-REFERENCE TO RELATED APPLICATION

This application is a national stage application under 35 U.S.C. § 371 of International Application No. PCT/CN2019/086425 filed May 10, 2019, which claims priority to Chinese Patent Application No. 201810725147.5, filed Jul. 4, 2018, the contents of which are incorporated by reference in the entirety.

TECHNICAL FIELD

The present invention relates to display technology, more particularly, to a pixel circuit and driving method thereof, a pixel unit, and a display panel.

BACKGROUND

Micro LED technology is a technology to form array of miniaturized light-emitting diodes all integrated on a chip with high density. It has many advantages in high emission efficiency, high luminance, high resolution, and fast response time. Application on the Micro LED technology to display panel has become a trend of state-of-art display technologies.

A display panel includes a plurality of pixel units surrounded by a plurality of data lines and a plurality of gate lines. The plurality of pixel units is arranged in an array. When the display panel is implemented with Micro LEDs, each pixel unit includes a LED device and a pixel circuit. The pixel circuit is configured to supply a voltage to the LED in the pixel unit to control its light emission, driving image display. Improved pixel circuit associated with Micro LED is desired to simplify the circuitry structure in the display panel.

SUMMARY

In an aspect, the present disclosure provides a pixel circuit. The pixel circuit includes an input circuit respectively connected with N gate lines, a control line, and N control nodes. The input circuit is configured to control voltage levels of the N control nodes under control of a respective one gate-driving signal from a respective one of the N gate lines and under control of a first control signal from the control line. The pixel circuit further includes a control circuit respectively connected with the N control nodes and 2N switching nodes. The control circuit is configured to control a voltage level of a respective one of the 2N switching nodes under control of the N control nodes. Additionally, the pixel circuit includes 2N output circuits respectively connected with 2N data-signal terminals. The 2N output circuits are connected with the 2N switching nodes, wherein an i-th output circuit of the 2N output circuits is coupled respectively with an i-th switching node of the 2N switching nodes, an i-th data-signal terminal of the 2N data-signal terminals, and an emission circuit. The i-th output circuit is configured to output an i-th data signal from the i-th data-signal terminal under control of the i-th switching node. N is a positive integer, i is a positive integer no greater than N.

Optionally, for the case that N is 2, the control circuit includes a latch subcircuit, a first control subcircuit, and a second control subcircuit. The $2^N$ switching nodes include a first switching node, a second switching node, a third switching node, and a fourth switching node. The N control nodes include a first control node and a second control node. The latch subcircuit is connected respectively to the first control node and a latch node configured to set a voltage level thereof under control of the first control node. The first control subcircuit is connected respectively to the latch node, the second control node, the first switching node, and a second switching node. The first control subcircuit is configured to respectively set voltage levels of the first switching node and the second switching node under control of the latch node and the second control node. The second control subcircuit is connected respectively to the first control node, the second control node, the third switching node, and the fourth switching node. The second control subcircuit is configured to respectively set voltage levels of the third switching node and the fourth switching node under control of the first control node and the second control node.

Optionally, the first control subcircuit includes a first control unit-circuit and a second control unit-circuit. The second control subcircuit includes a third control unit-circuit and a fourth control unit-circuit. The first control unit-circuit is connected respectively to the latch node, the second control node, the first switching node, and the second switching node. The first control unit-circuit is configured to respectively set voltage levels of the first switching node and the second switching node under control of the latch node and the second control node. The second control unit-circuit is connected respectively to the latch node, a pull-down power supply, the first switching node, and the second switching node. The second control unit-circuit is configured to respectively set voltage levels of the first switching node and the second switching node under control of a pull-down voltage from the pull-down power supply. The third control unit-circuit is connected respectively to the first control node, the second control node, the third switching node, and the fourth switching node. The third control unit-circuit is configured to respectively set voltage levels of the third switching node and the fourth switching node under control of the first control node and the second control node. The fourth control unit-circuit is connected respectively to the first control node, the pull-down power supply, the third switching node, and the fourth switching node. The fourth control unit-circuit is configured to respectively set voltage levels of the third switching node and the fourth switching node under control of the first control node and the pull-down voltage.

Optionally, the first control unit-circuit includes a first latch having an input terminal connected to the second control node and an output terminal connected to the first switching node. The third control unit-circuit includes a second latch having an input terminal connected to the second control node and an output terminal connected to the third control node.

Optionally, the first latch includes a first tri-state gate and a second tri-stage gate. The second latch includes a third tri-state gate and a fourth tri-state gate. The first tri-state gate includes a control terminal connected to the latch node, an input terminal connected to the second control node, and an output terminal connected to the first switching node. The second tin-state gate includes a control terminal connected to the latch node, an input terminal connected to the first switching node, and an output terminal connected to the second control node. The third tri-state gate includes a control terminal connected to the first control node, an input terminal connected to the second control node, and an output terminal connected to the third switching node. The fourth tri-state gate includes a control terminal connected to the first control node, an input terminal connected to the third switching node, and an output terminal connected to the second control node.

Optionally, the second control unit-circuit includes a first transistor and a second transistor. The fourth control unit-circuit includes a third transistor and a fourth transistor. The first transistor has a gate terminal connected to the latch node, a first terminal connected to the pull-down power supply, and a second terminal connected to the first switching node. The second transistor has a gate terminal connected to the latch node, a first terminal connected to the pull-down power supply, and a second terminal connected to the second switching node. The third transistor has a gate terminal connected to the first control node, a first terminal connected to the pull-down power supply, and a second terminal connected to the third switching node. The fourth transistor has a gate terminal connected to the first control node, a first terminal connected to the pull-down power supply, and a second terminal connected to the fourth switching node.

Optionally, the latch subcircuit includes a third latch having an input terminal connected to the first control node and an output terminal connected to the latch node.

Optionally, the third latch includes a first non-gate and a second non-gate. The first non-gate has an input terminal connected to the first control node and an output terminal connected to the latch node. The second non-gate has an input terminal connected to the latch node and an output terminal connected to the first control node.

Optionally, for the case that N is 1, the $2^N$ switching nodes includes a first switching node and a third switching node, the N control node is a first control node. The control circuit is connected respectively to the first control node, the first switching node, and the third switching node. The control circuit is configured to set voltage levels of the first switching node and the third switching node under control of the first control node.

Optionally, the i-th output circuit includes an i-th output transistor having a gate terminal connected to the i-th switching node, a first terminal connected to the i-th data-signal terminal, and a second terminal connected to the emission circuit.

Optionally, the input circuit includes N input transistors among which a j-th input transistor having a gate terminal connected to a j-th gate line, a first terminal connected to the control line, and a second terminal connected to a j-th control node, wherein j is a positive integer no greater than N.

In another aspect, the present disclosure provides a driving method of a pixel circuit described herein. The method includes providing a gate-driving signal at a turn-on voltage level to a j-th gate line of the N gate lines so that the input circuit transports a first control signal in the control line to a corresponding j-th control node of the N control nodes. Here j is a positive integer no greater than N. Additionally, the method includes setting one switching node of the $2^N$ switching nodes to a turn-on voltage level under control of the N control nodes so that a corresponding one output circuit connected to the one switching node is to input a data signal from a corresponding data-signal terminal connected to the corresponding one output circuit to the emission circuit. The $2^N$ output circuits are connected respectively to the $2^N$ switching nodes. The $2^N$ output circuits are connected respectively to data-signal terminals. The $2^N$ data-signal terminals supply different data signals.

Optionally, the $2^N$ data-signal terminals supply different data signals with different amplitudes.

Optionally, the $2^N$ data-signal terminals supply different data signals with different duty cycles.

Optionally, for the case that N is 2, the control circuit includes a latch subcircuit, a first control subcircuit, and a second control subcircuit. The $2^N$ switching nodes includes a first switching node, a second switching node, a third switching node, and a fourth switching node. The N control nodes includes a first control node and a second control node. The method includes setting the first control node at a turn-off voltage level and the second control node at a turn-off voltage level, so that the control circuit sets the first switching node to the turn-off voltage level, the second switching node to the turn-off voltage level, the third switching node to a turn-on voltage level, and the fourth switching node to the turn-off voltage level. The method further includes setting the first control node at a turn-off voltage level and the second control node at a turn-on voltage level, so that the control circuit sets the first switching node to the turn-off voltage level, the second switching node to the turn-off voltage level, the third switching node to the turn-off voltage level, and the fourth switching node to the turn-on voltage level. Additionally, the method includes setting the first control node at a turn-on voltage level and the second control node at a turn-off voltage level, so that the control circuit sets the first switching node to the turn-on voltage level, the second switching node to the turn-off voltage level, the third switching node to the turn-off voltage level, and the fourth switching node to the turn-off voltage level. Furthermore, the method includes setting the first control node at a turn-on voltage level and the second control node at the turn-on voltage level, so that the control circuit sets the first switching node to a turn-off voltage level, the second switching node to the turn-on voltage level, the third switching node to the turn-off voltage level, and the fourth switching node to the turn-off voltage level.

Optionally, for the case that N is 1, the $2^N$ switching nodes includes a first switching node and a third switching node, the N control node is a first control node. The method includes setting the first control node to a turn-on voltage level, so that the control circuit sets the first switching node to a turn-off voltage level and the third switching node to the turn-on voltage level. Additionally, the method includes setting the first control node to a turn-off voltage level, so that the control circuit sets the first switching node to a turn-on voltage level and the third switching node to the turn-off voltage level.

In yet another aspect, the present disclosure provides a pixel unit including an emission circuit and a pixel circuit described herein. The pixel circuit includes an output circuit coupled to the emission circuit.

Optionally, the emission circuit includes a switching subcircuit and an emitting subcircuit. The switching subcircuit is connected respectively to a second control-signal terminal. The output circuit is connected to the emitting subcircuit. The switching subcircuit is configured to input a signal from the output circuit to the emitting subcircuit under control of a second control signal from the second control-signal terminal.

Optionally, the emission circuit includes a switching subcircuit and an emitting subcircuit. The switching subcircuit is connected respectively to a second control-signal terminal, a pull-up power supply, the output circuit, and the emitting subcircuit. The switching subcircuit is configured to input a pull-up voltage signal from the pull-up power supply to the emitting subcircuit under control of a second control signal from the second control-signal terminal.

In still another aspect, the present disclosure provides a display panel including a plurality of pixel units. Each of the plurality of pixel units is the pixel unit described herein.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

The pixel circuit of a display panel, in some embodiments of the present disclosure, uses transistors as basic functional circuit elements. Optionally, all transistors can be selected from thin-film transistors, field-effect transistors or other devices having same functionalities. In the pixel circuit, major functions adopted by the transistors is a switching transistor with its drain terminal and source terminal being configured symmetrically or interchangeable. In the present disclosure, the drain terminal of a switching transistor is referred to a first terminal and the source terminal is referred to a second terminal. Typically for a circuit symbol of the switching transistor, a middle terminal is a gate terminal, signal input terminal is the source terminal, and signal output terminal is the drain terminal. Additionally, all switching transistors adopted in the pixel circuits of the present disclosure are N-type transistor. The N-type transistor is turned on when the gate terminal is set to a high voltage level and turned off when the gate terminal is set to a low voltage level. Further, in the present disclosure, many control signals adopted in the pixel circuits have basically two states, a corresponding effective voltage level at a turn-on voltage level and an ineffective voltage level at a turn-off voltage level.

Figure 1:
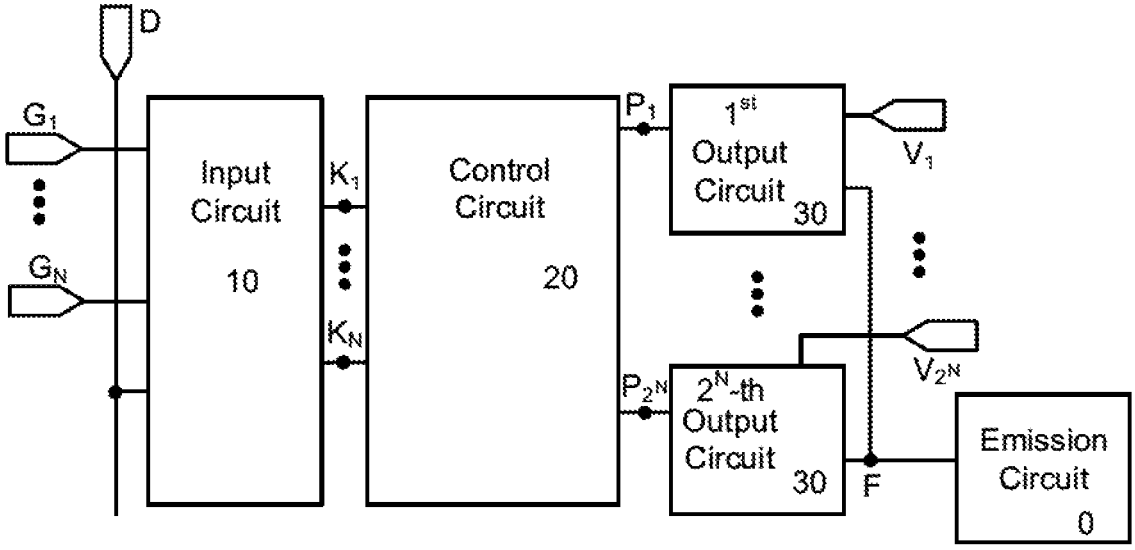
FIG. 1 is a block diagram of a pixel circuit according to some embodiments of the present disclosure.

Accordingly, the present disclosure provides, inter alia, a pixel circuit based on transistors, a method for driving the pixel circuit, a pixel unit associated with micro LED, a display panel having the same that substantially obviate one or more of the problems due to limitations and disadvantages of the related art. In one aspect, the present disclosure provides a pixel circuit that is, in some embodiments, implemented in a pixel unit associated with micro LED. FIG. 1 is a block diagram of a pixel circuit according to some embodiments of the present disclosure. Referring to FIG. 1, the pixel circuit includes an input circuit 10, a control circuit 20, and $2^N$ numbers of output circuits 30 coupled each other, where N is a positive integer.

The input circuit 10 is connected respectively with N numbers of gate lines (denoted respectively by gate line $G_1$ to gate line $G_N$ in FIG. 1), a control line D, and N numbers of control nodes (denoted respectively by $K_1$ through $K_N$ in FIG. 1). The input circuit 10 is configured to control voltage levels of the N control nodes respectively under control of every gate-driving signal from every one of the N gate lines and a first control signal from the control line D. The control line D is also referred as a data line.

The control circuit 20 is connected respectively with the N control nodes and $2^N$ numbers of switching nodes (denoted respectively by $P_1$ through $P_{2N}$ in FIG. 1) and is configured to respectively control a voltage level of a respective one of the $2^N$ switching nodes under control of the N control nodes.

The $2^N$ output circuits 30 are connected respectively with $2^N$ numbers of data-signal terminals (denoted respectively by $V_1$ through $V_2N$ in FIG. 1) and are connected respectively with the $2^N$ switching nodes.

In an embodiment, among the $2^N$ output circuits 30, an i-th output circuit is connected respectively with an i-th switching node $P_i$, an i-th data-signal terminal $V_i$, and an emission circuit 0. Here, i is a positive integer no greater than N. The i-th output circuit 30 is configured to input the i-th data signal from the i-th data-signal terminal to the emission circuit 0 under control of the i-th switching node $P_i$.

The pixel circuit of the present disclosure includes a control circuit and $2^N$ output circuits. The control circuit is controlled by N control nodes and used to control a voltage level of every switching node of $2^N$ switching nodes. Further, the i-th output circuit of the $2^N$ output circuits is configured to input the i-th data signal from the i-th data-signal terminal to an emission circuit under control of the i-th switching node. Thus, one control circuit can control 2N output circuits, enhancing utilization rate of the components and reducing structural complexity in the pixel circuit to be implemented in a pixel unit associated with micro LED.

Optionally, the input circuit and output circuit are all formed with transistors. Among the $2^N$ output circuits 30, the i-th output circuit includes an i-th output transistor. The i-th output transistor has a gate terminal connected to the i-th switching node $P_i$. The i-th output transistor has a first terminal connected to the i-th data-signal terminal $V_i$. The i-th output transistor also has a second terminal connected to the emission circuit 0. When the i-th switching node $P_i$ is set to a turn-on voltage level, the i-th output transistor in the i-th output circuit is turned on, so that the i-th data-signal terminal can provide the i-th data signal via the i-th output transistor to the emission circuit 0.

Optionally, the input circuit 10 includes N input transistors. Among the N input transistors, the j-th input transistor has a gate terminal connected to a j-th gate line. Here j is a positive integer no greater than N. The j-th input transistor has a first terminal connected to the control line. The j-th input transistor also has a second terminal connected to the j-th control node. When a gate-driving signal from the i-th gate line is set to a turn-on voltage level, the j-th input transistor is turned on, so that the control line D can input a first control signal via the j-th input transistor to the j-th control node.

Figure 2:
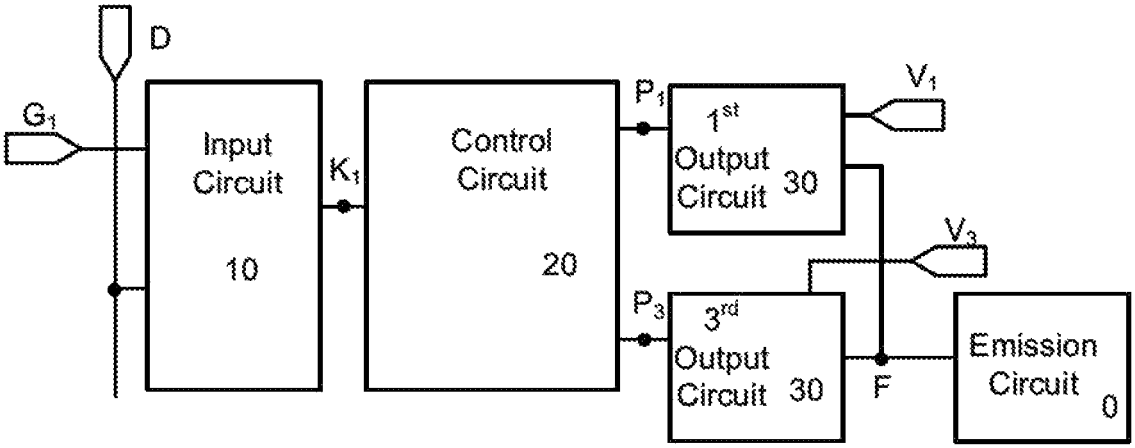
FIG. 2 is a block diagram of the pixel circuit of FIG. 1 with N=1 according to an embodiment of the present disclosure.

Optionally, N can be selected from different positive integers, accordingly the control circuit 20 in the pixel circuit can be formed differently. When N=1, $2^N$=2. the pixel circuit is shown as that in FIG. 2. The input circuit 10 is respectively connected with a first gate line G1 and a first control node K1. 2 switching nodes include a first switching node P1 and a third switching node P3. The pixel circuit includes two output circuits: a first output circuit and a third output circuit, both still denoted by numerical 30 in FIG. 2. The first output circuit 30 is connected to a data-signal terminal V1 and the third output circuit 30 is connected to another data-signal terminal V3. The control circuit 20 of the pixel circuit in FIG. 2 is connected respectively with the first control node K1, the first switching node P1, and the third switching node P3. The control circuit 20 is configured to control voltage levels of the first switching node P1 and the third switching node P3 under control of the first control node K1.

In a specific embodiment, the control circuit 20 is functioned as shown below. When the first control node K1 is set to a turn-on voltage level, the control circuit 20 can control the first switching node P1 to a turn-off voltage level and the third switching node P3 to a turn-on voltage level. When the first control node K1 is set to a turn-off voltage level, the control circuit 20 can control the first switching node P1 to a turn-on voltage level and the third switching node P3 to a turn-off voltage level.

Figure 3:
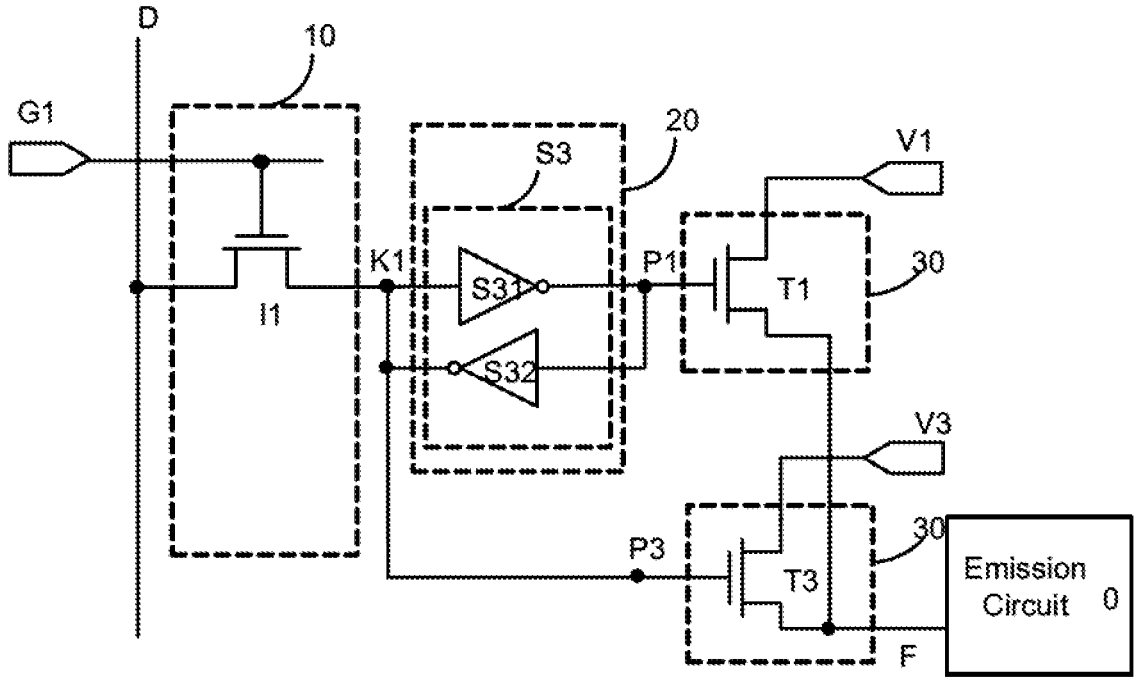
FIG. 3 is a schematic diagram of the pixel circuit of FIG. 2 according to an embodiment of the present disclosure.

Optionally, the control circuit 20 is achieved by a latch based on switching transistors. FIG. 3 shows a schematic diagram of the pixel circuit of FIG. 2 according to an embodiment of the present disclosure, in which the control circuit 20 includes a third latch S3. The third latch S3 has an input terminal connected to the first control node K1 and an output terminal connected to the first switching node P1.

A latch can be used for storing signal statically. When the control circuit 20 is provided as the third latch S3, its static signal storage function can be used to enhance anti-noise ability of signal transport during the pixel circuit operation and enhance output stability of the output circuit.

Additionally, the latch provides a non-gate function. Referring to FIG. 3, the third latch S3 includes a first non-gate S31 and a second non-gate S32. The first non-gate S31 has an input terminal connected to the first control node K1 and an output terminal connected to the first switching node P1. The second non-gate S32 has an input terminal connected to the first switching node P1 and an output terminal connected to a first control node K1.

Optionally, referring to FIG. 3, the first output circuit 30 includes a first output transistor T1. The third output circuit 30 includes a third output transistor T3. The first output transistor T1 has a gate terminal connected to the first switching node P1, a first terminal connected to the first data-signal terminal V1, and a second terminal connected to the emission circuit 0. When the first switching node P1 is set to a turn-on voltage level, the first output transistor T1 is turned on, so that a data signal from the first data-signal terminal V1 is able to be inputted through the first output transistor T1 o the emission circuit 0.

The third output transistor T3 has a gate terminal connected to the third switching node P3, a first terminal connected to the third data-signal terminal V3, and a second terminal connected to the emission circuit 0. When the third switching node P3 is set to a turn-on voltage level, the third output transistor T3 is turned on, so that a data signal from the third data-signal terminal V3 is able to be passed through the third output transistor T3 to the emission circuit 0.

Referring again to FIG. 3, the input circuit 10 includes a first input transistor I1. The first input transistor I1 has a gate terminal connected to the first gate line G1, a first terminal connected to the control line D, and a second terminal connected to the first control node K1. When a gate-driving signal from the first gate line G1 is set to a turn-on voltage level, the first input transistor I1 is turned on, so that a first control signal from the control line D can be passed through the first input transistor I1 to the first control node K1.

In the case of N=1, the pixel circuit utilizes the control circuit 20 to control voltage levels at two switching nodes. At any time, one switching node (of the two switching nodes) is always set to a turn-on voltage level. The switching node at the turn-on voltage level is thus able to control a corresponding output circuit 30 connected therewith, and provide a data signal via the corresponding output circuit 30 to the emission circuit. Further, when there is a difference between a data signal from the first data-signal terminal V1 and another data signal from the third data-signal terminal V3, the control circuit 20 under control of one switching node that is set to the turn-on voltage level can provide different data signal to the emission circuit at different timing periods so that the pixel unit can achieve multi-grayscale level display.

Figure 4:
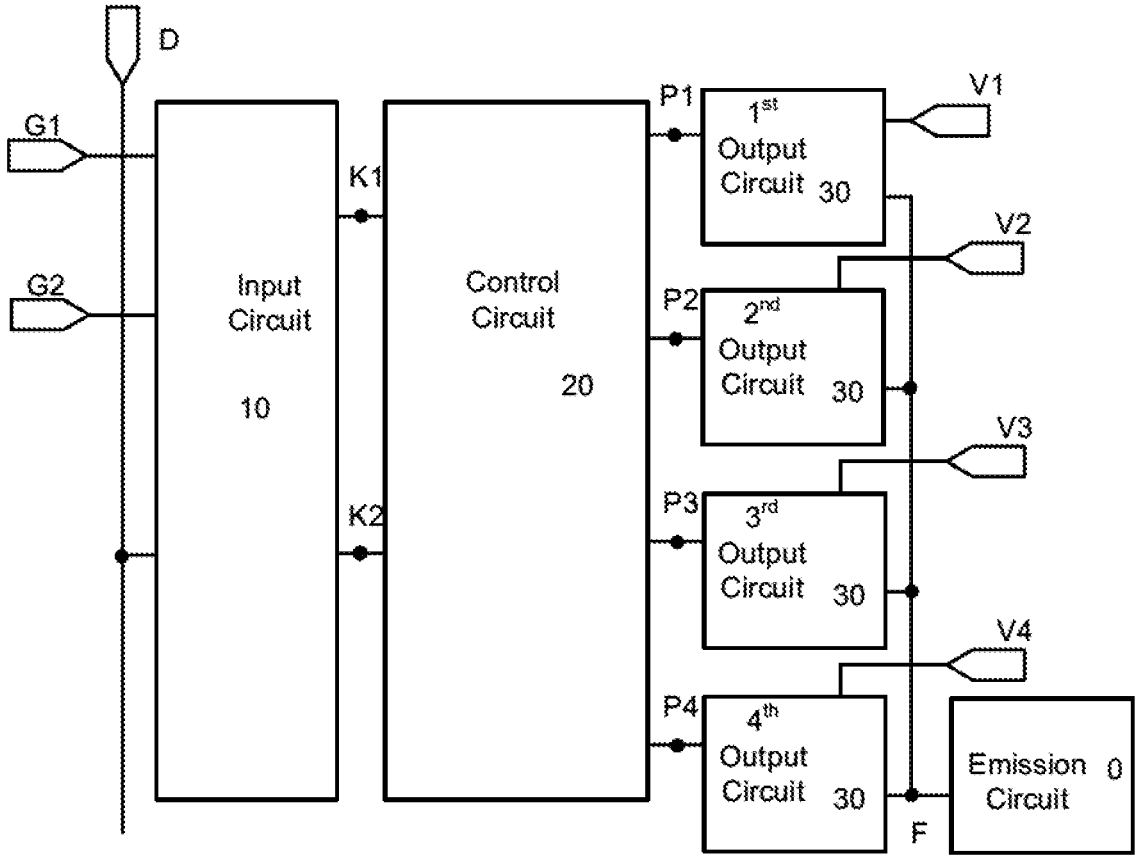
FIG. 4 is a block diagram of the pixel circuit of FIG. 1 with N=2 according to an embodiment of the present disclosure.

When N=2, $2^N$=4. The pixel circuit of FIG. 1 is illustrated in FIG. 4. The input circuit 10 is connected respectively with a first gate line G1, a second gate line G2, a first control node K1, and a second control node K2. The 4 switching nodes include a first switching node P1, a second switching node P2, a third switching node P3, and a fourth switching node P4. The pixel circuit includes 4 output circuits, a first output circuit, a second output circuit, a third output circuit, and a fourth output circuit. The first output circuit is connected to a data-signal terminal V1. The second output circuit is connected to a data-signal terminal V2. The third output circuit is connected to a data-signal terminal V3. The fourth output circuit is connected to a data-signal terminal V4.

Figure 5:
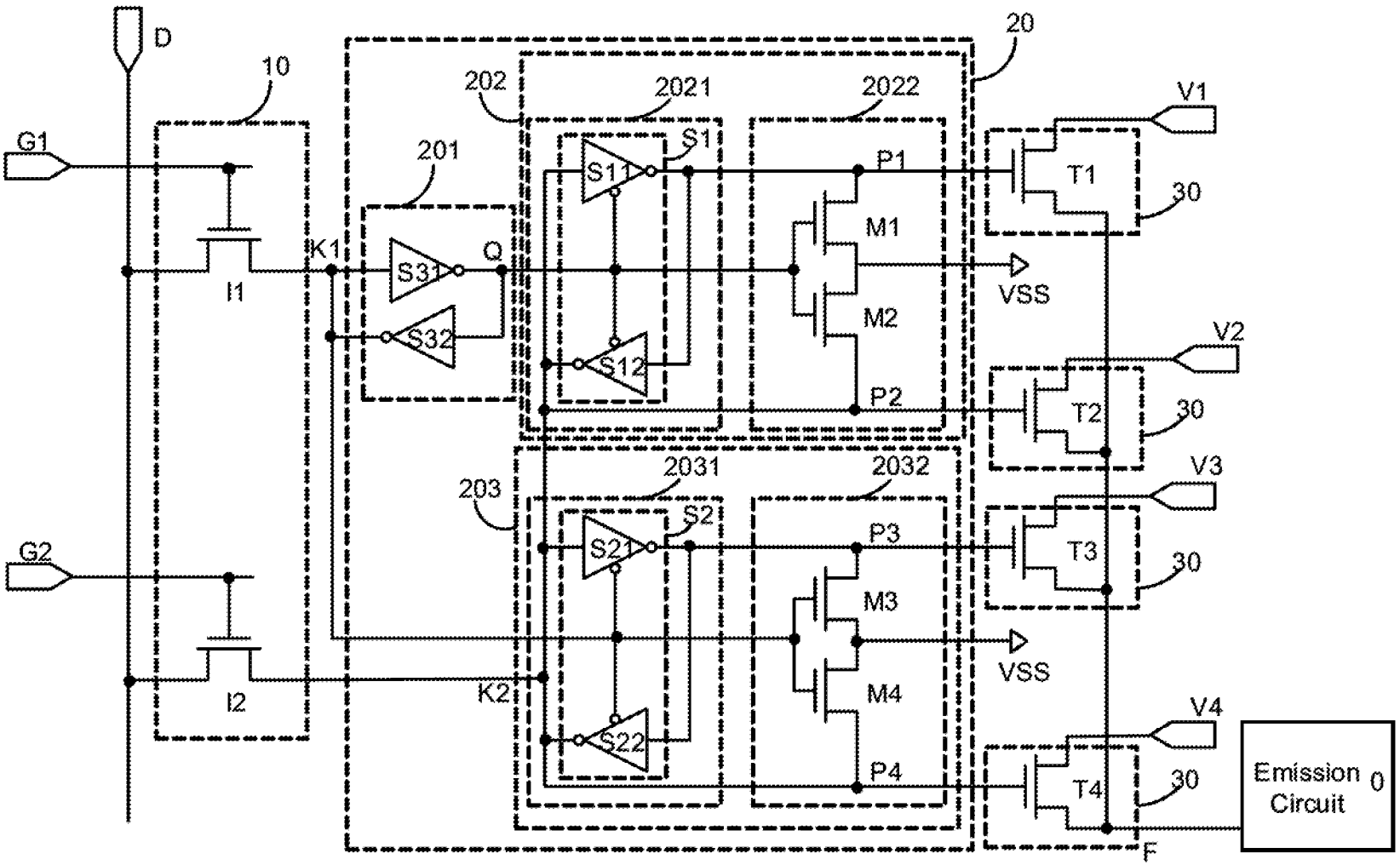
FIG. 5 is a schematic diagram of the pixel circuit of FIG. 4 according to an embodiment of the present disclosure.

Additionally, referring to FIG. 5 which shows a schematic diagram of the pixel circuit of FIG. 4 according to an embodiment of the present disclosure, the control circuit 20 includes a latch subcircuit 201, a first control subcircuit 202, and a second control subcircuit 203. The latch subcircuit 201 is connected respectively with the first control node K1 and a latch node Q. The latch subcircuit 201 is configured to control the latch node Q to a turn-off voltage level when the first control node K1 is set to a turn-on voltage level and to control the latch node Q to a turn-on voltage level when the first control node K1 is set to a turn-off voltage level.

The first control subcircuit 202 is connected respectively to the latch node Q, the second control node K2, the first switching node P1, and the second switching node P2. The first control subcircuit 202 is configured to control respective voltage levels of the first switching node P1 and the second switching node P2 under control of the latch node Q and the second control node K2.

In particular, when the latch node Q is set to a turn-off voltage level and the second control node K2 is set to a turn-off voltage level, the first control subcircuit 202 controls the first switching node P1 to a turn-on voltage level and the second switching node P2 to the turn-off voltage level. When the latch node Q is set to a turn-off voltage level and the second control node K2 is set to a turn-on voltage level, the first control subcircuit 202 controls the first switching node P1 to the turn-off voltage level and the second switching node P2 to the turn-on voltage level. When the latch node Q is set to a turn-on voltage level and the second control node K2 is set to a turn-off voltage level, the first control subcircuit 202 controls the first switching node P1 to a turn-off voltage level and the second switching node P2 to the turn-off voltage level. When the latch node Q is set to a turn-on voltage level and the second control node K2 is set to the turn-on voltage level, the first control subcircuit 202 controls the first switching node P1 to a turn-off voltage level and the second switching node P2 to the turn-off voltage level.

The second control subcircuit 203 is connected respectively to the first control node K1, the second control node K2, the third switching node P3, and the fourth switching node P4. The second control subcircuit 203 is configured to control respective voltage levels of the third switching node P3 and the fourth switching node P4 under control of the first control node K1 and the second control node K2.

In particular, when the first control node K1 is set to a turn-off voltage level and the second control node K2 is set to the turn-off voltage level, the second control subcircuit 203 controls the third switching node P3 to a turn-on voltage level and the fourth switching node P4 to the turn-off voltage level. When the first control node K1 is set to a turn-off voltage level and the second control node K2 is set to a turn-on voltage level, the second control subcircuit 203 controls the third switching node P3 to the turn-off voltage level and the fourth switching node P4 to the turn-on voltage level. When the first control node K1 is set to a turn-on voltage level and the second control node K2 is set to the turn-off voltage level, the second control subcircuit 203 controls the third switching node P3 to the turn-off voltage level and the fourth switching node P4 to the turn-off voltage level. When the first control node K1 is set to a turn-on voltage level and the second control node K2 is set to the turn-on voltage level, the second control subcircuit 203 controls the third switching node P3 to a turn-off voltage level and the fourth switching node P4 to the turn-off voltage level.

Referring to FIG. 5 again, the first control subcircuit 202 includes a first control unit-circuit 2021 and a second control unit-circuit 2022. The first control unit-circuit 2021 is connected respectively to the latch node Q, the second control node K2, the first switching node P1, and the second switching node P2. The first control unit-circuit 2021 is configured to control respective voltage levels of the first switching node P and the second switching node P2 under control of the latch node Q and the second control node K2. The control scheme of the first control unit-circuit 2021 to the first switching node P1 and the second switching node P2 can be referred to the control scheme of the first control subcircuit 202 to the first switching node P1 and the second switching node P2 under control of the voltage levels at the latch node Q and the second control node K2.

The second control unit-circuit 2022 is connected respectively to the latch node Q, a pull-down power supply VSS, the first switching node P1, and the second switching node P,2. The second control unit-circuit 2022 is configured, when the latch node Q is set to a turn-on voltage level, to supply a pull-down voltage signal from the pull-down power supply VSS respectively to the first switching node P1 and the second switching node P2. The pull-down voltage signal is set as a turn-off voltage level.

Referring to FIG. 5 again, the second control subcircuit 203 includes a third control unit-circuit 2031 and a fourth control unit-circuit 2032. The third control unit-circuit 2031 is connected respectively to the first control node K1, the second control node K2, the third switching node P3, and the fourth switching node P4. The third control unit-circuit 2031 is configured to respectively control voltage levels of the third switching node P3 and the fourth switching node P4 under control of the first control node K1 and the second control node K2. The control scheme of the third control unit-circuit 2031 to the third switching node P3 and the fourth switching node P4 can be referred to the control scheme of the second control subcircuit 203 to the third switching node P3 and the fourth switching node P4 under control of the voltage levels at the first control node K1 and the second control node K2.

The fourth control unit-circuit 2032 is connected respectively to the first control node K1, the pull-down power supply VSS, the third switching node P3, and the fourth switching node P4. The fourth control unit-circuit 2032 is configured to control respective voltage levels of the third switching node P3 and the fourth switching node P4 under control of the first control node K1 and a pull-down voltage signal. When the first control node K1 is set to a turn-on voltage level, the fourth control unit-circuit 2032 supplies the pull-down voltage signal from the pull-down power supply VSS respectively to the third switching node P3 and the fourth switching node P4. The pull-down voltage signal is set to a turn-off voltage level.

As seen in FIG. 5, by controlling the voltage levels of the first switching node P1 and the second switching node P2 commonly through the first control unit-circuit 2021 and the second control unit-circuit 2022, and by controlling the voltage levels of the third switching node P3 and the fourth switching node P4 commonly through the third control unit-circuit 2031 and the fourth control unit-circuit 2032, it is achievable to control multiple switching nodes respectively when the first control node K1 and the second control node K2 are set to different voltage levels. This also ensures that only one switching node is set to a turn-on voltage level at a time, guaranteeing that the pixel unit to display normally.

In an implementation, the first control unit-circuit 2021 and the third control unit-circuit 2031 can be formed via a latch circuit. For example, as shown in FIG. 5, the first control unit-circuit 2021 includes a first latch S1 and the third control unit-circuit 2031 includes a second latch S2. The first latch S1 has an input terminal connected to the second control node K2 and an output terminal connected to the first switching node P1. The second latch S2 has an input terminal connected to the second control node K2 and an output terminal connected to the third switching node P3.

The latch circuit like that shown in FIG. 5 is able to store signal in static state. The first control unit-circuit 2021 and the third control unit-circuit 2031 are capable of storing the respective signals thereof in static state through the first latch S1 and the second latch S2. This enhances anti-noise capability for the signal handled by the corresponding control unit.

In a specific embodiment, each of the first latch S1 and the second latch S2 are provided in a tri-state gate. Referring to FIG. 5, the first latch S1 includes a first tri-state gate S11 and a second tri-state gate S12. The second latch S2 includes a third tri-state gate S21 and a fourth tri-state gate S22. The first tri-state gate S11 includes a control terminal connected to the latch node Q, an input terminal connected to the second control node K2, and an output terminal connected to the first switching node P1. The second tri-state gate S12 includes a control terminal connected to the latch node Q, an input terminal connected to the first switching node P1, and an output terminal connected to the second control node K2. The third tri-state gate S21 includes a control terminal connected to the first control node K1, an input terminal connected to the second control node K2, and an output terminal connected to the third switching node P3. The fourth tri-state gate S22 includes a control terminal connected to the first control node K1, an input terminal connected to the third switching node P3, and an output terminal connected to the second control node K2.

Optionally, the second control unit-circuit 2022 and the fourth control unit-circuit 2032 can be formed with transistors. Referring to FIG. 5, in an example, the second control unit-circuit 2022 includes a first transistor M1 and a second transistor M2. The fourth control unit-circuit 2032 includes a third transistor M3 and a fourth transistor M4. The first transistor M1 has a gate terminal connected to the latch node Q, a first terminal connected to the pull-down power supply VSS, and a second terminal connected to the first switching node P1. The second transistor M2 has a gate terminal connected to the latch node Q, a first terminal connected to the pull-down power supply VSS, and a second terminal connected to the second switching node P2. The third transistor M3 has a gate terminal connected to the first control node K1, a first terminal connected to the pull-down power supply VSS, and a second terminal connected to the third switching node P3. The fourth transistor M4 has a gate terminal connected to the first control node K1, a first terminal connected to the pull-down power supply VSS, and a second terminal connected to the fourth switching node P4.

Additionally, the latch subcircuit 201 can also be formed via a latch circuit. For example, as shown in FIG. 5, the latch subcircuit 201 includes a third latch S3 having an input terminal connected to the first control node K1 and an output terminal connected to the latch node Q. The latch subcircuit 201 can utilize the function of static signal storage of the third latch S3 to enhance its signal-to-noise ratio for the signals handled thereby.

Optionally, the third latch S3 is formed as a non-gate. As seen in FIG. 5, the third latch S3 includes a first non-gate S31 and a second non-gate S32. The first non-gate S31 has an input terminal connected to the first control node K1 and an output terminal connected to the latch node Q. The second non-gate S32 has an input terminal connected to the latch node Q and an output terminal connected to the first control node K1.

Referring to FIG. 5 again, the first output circuit includes a first output transistor T1. The second output circuit includes a second output transistor T2. The third output circuit includes a third output transistor T3. The fourth output circuit includes a fourth output transistor T4. The first output transistor T1 includes a gate terminal connected to the first switching node P1, a first terminal connected to a first data-signal terminal V1, and a second terminal connected to the emission circuit 0. The second output transistor T2 includes a gate terminal connected to the second switching node P2, a first terminal connected to a second data-signal terminal V2, and a second terminal connected to the emission circuit 0. The third output transistor T3 includes a gate terminal connected to the third switching node P3, a first terminal connected to a third data-signal terminal V3, and a second terminal connected to the emission circuit 0. The fourth output transistor T4 includes a gate terminal connected to the fourth switching node P4, a first terminal connected to a fourth data-signal terminal V4, and a second terminal connected to the emission circuit 0. A control scheme of controlling the output transistors through voltages at corresponding switching nodes to provide corresponding data signal from respective one of data-signal terminal can be referred to that described earlier in the case of N=1.

Referring to FIG. 5 again, the input circuit 10 includes a first input transistor I1 and a second input transistor 12. The first input transistor I1 has a gate terminal connected to the first gate line G1, a first terminal connected to the control line D, and a second terminal connected to the first control node K1. The second input transistor 12 has a gate terminal connected to the second gate line G2, a first terminal connected to the control line D, and a second terminal connected to the second control node K2. A control scheme of controlling the input transistors through gate-driving signals from corresponding gate lines to set voltage levels for the corresponding control nodes can be referred to that described earlier in the case of N=1.

In the case of N=2, controlling voltage levels of four switching nodes through the control circuit 20 allows that in any time point there is one switching node being set to a turn-on voltage level. Through this switching node being set at the turn-on voltage level, a corresponding output circuit can be controlled to provide a proper data signal from one corresponding data-signal terminal. When data signals from the first data-signal terminal V1, the second data-signal terminal V2, the third data-signal terminal V3, and the fourth data-signal terminal V4 are different, different data signals can be controlled by a switching node with the turn-on voltage level to be passed to the emission circuit at different time periods, yielding multiple grayscale levels for the pixel unit for an emission circuit based on micro LED.

The pixel circuit of the present disclosure includes a control circuit and $2^N$ output circuits. The control circuit is controlled by N control nodes and used to control a voltage level of every switching node of $2^N$ switching nodes. Further, the i-th output circuit of the $2^N$ output circuits is configured to input the i-th data signal from the i-th data-signal terminal to an emission circuit under control of the i-th switching node. Thus, one control circuit can control 2N output circuits, enhancing utilization rate of the circuit components and reducing structural complexity in the pixel circuit to be implemented in a pixel unit associated with micro LED.

As shown in FIG. 3 and FIG. 5, the transistors adopted in the pixel circuit are all switching thin-film transistors (STFT) which has relatively smaller power consumption during circuit operation. Effectively, the pixel circuit of the present disclosure has an advantage of reduced power consumption.

Figure 6:
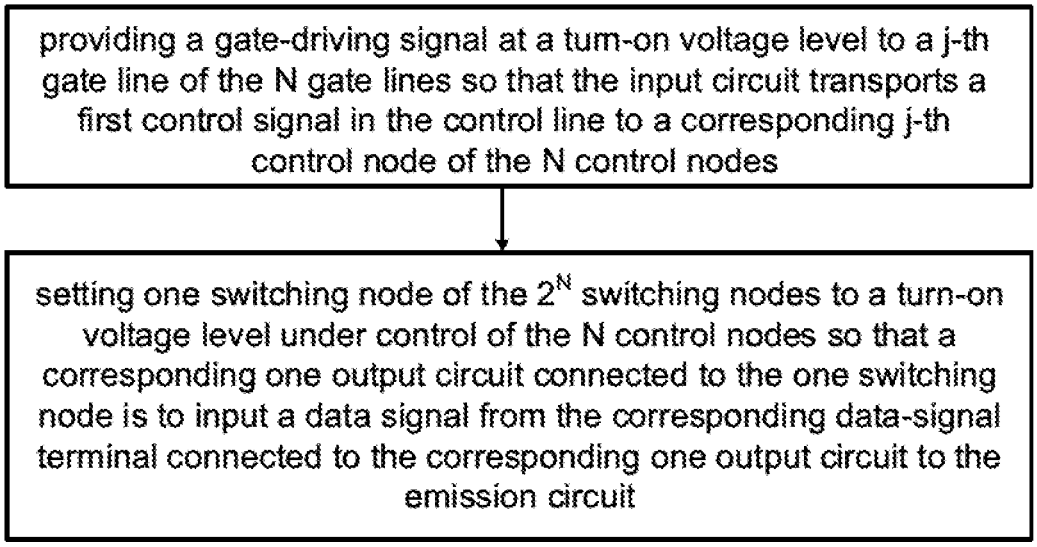
FIG. 6 is a flow chart of a method for driving the pixel circuit according to an embodiment of the present disclosure.
Figure 7:
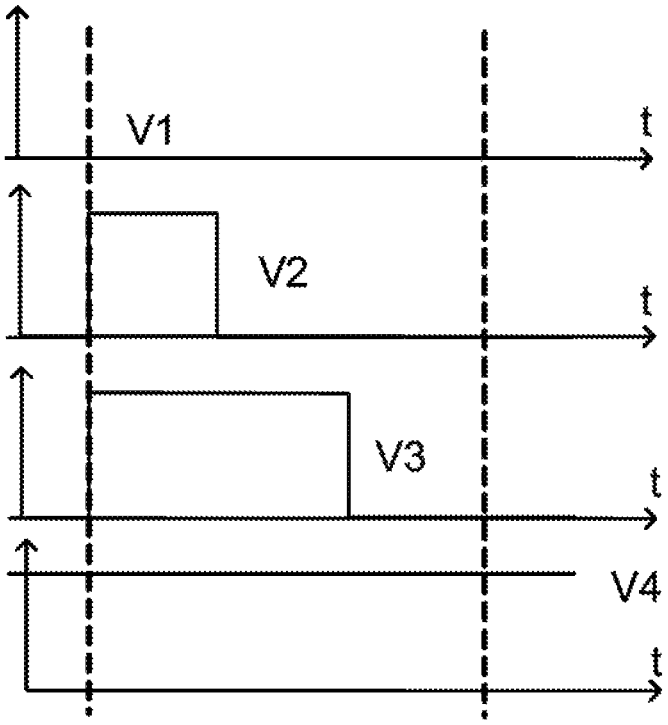
FIG. 7 is a schematic diagram of four signals with different duty cycles from four data-signal terminals according to an embodiment of the present disclosure.

In another aspect, the present disclosure provides a method for driving a pixel circuit. Particularly, the pixel circuit described herein for driving an emission circuit based on a micro LED. FIG. 6 is a flow chart of a method for driving the pixel circuit according to an embodiment of the present disclosure. Based on the pixel circuit shown in FIG.

1, referring FIG. 6, the method for driving the pixel circuit includes a step of providing a gate-driving signal at a turn-on voltage level to a j-th gate line of the N gate lines so that the input circuit transports a first control signal in the control line to a corresponding j-th control node of the N control nodes, where j is a positive integer no greater than N. Additionally, the method includes a step of setting one switching node of the $2^N$ switching nodes to a turn-on voltage level under control of the N control nodes so that a corresponding one output circuit connected to the one switching node is to input a data signal from the corresponding data-signal terminal connected to the corresponding one output circuit to the emission circuit. As shown in FIG. 1, the $2^N$ output circuits are connected respectively to the $2^N$ switching nodes, the $2^N$ output circuits are connected respectively to $2^N$ data-signal terminals, the $2^N$ data-signal terminals supply different data signals.

In the embodiment the method is to control the j-th control node voltage level based on a gate-driving signal from the j-th gate line and the first control signal from the control line. Further, the method is to control corresponding switching node voltage level based on the j-th control node voltage level. Furthermore, the method is to control one of $2^N$ output circuits based on the corresponding switching node voltage level to provide a data signal for an emission circuit needed for emitting light for image display. Basically, the method is able to use one control circuit to control $2^N$ output circuits, enhancing utilization rate of the circuit components and reducing structural complexity in the pixel circuit to be implemented in a pixel unit associated with micro LED.

Additionally, the data signals from the $2^N$ data-signal terminals can be different. By setting, one at a time, one of the $2^2$ switching nodes to a turn-on voltage level, different switching node can be set to the turn-on voltage level at different time to control different output circuit to provide the different data signal to the emission circuit to drive (the micro LED) light emission with different luminance associated with different light-on time. This allows the pixel unit to display with multi-level grayscale.

Optionally, the data signal is a voltage signal. Different data signals supplied to the $2^N$ data-signal terminals have different amplitudes. For example, the four data signals from the four data-signal terminals are respectively 4 V, 6 V, 8 V, and 12 V. Optionally, the emission circuit includes a micro LED. The emission circuit emits light with a luminance proportional to the amplitude of the data signal supplied therein. When the data signal that is inputted to the emission circuit is a voltage signal with different amplitude, the luminance of the emitted light by (micro LED in) the emission circuit will be different. Therefore, by respectively inputting voltage signals with different amplitudes from the $2^N$ data-signal terminals to the emission circuit, an emission luminance of the emission circuit can be controlled. Potentially, the pixel unit associated with the pixel circuit of the present disclosure coupled with the emission circuit based on micro LED can achieve total $2^N$ levels in pixel grayscales.

Alternatively, different data signals supplied to the $2^N$ data-signal terminals have different duty cycles. For example, the four data signals from the four data-signal terminals are provided with respective duty cycles of 0%, 33%, 66%, and 100%. Based on integral effect of human vision, the longer of a light emission, the brighter the brightness perceived by the human eye. By controlling different duty cycles of the data signals from the $2^N$ data-signal terminals, the emission time-duration of the emission circuit can be controlled so that different brightness can be perceived by human eye based on a length of the emission time-duration. This also enables the pixel unit associated with the pixel circuit of the present disclosure coupled with the emission circuit based on micro LED to achieve total $2^N$ levels in pixel grayscales.

An emission efficiency of an emission circuit (e.g., based on the micro LED) varies with a change of current density of the data signal inputted therein. When different data signals from the $2^N$ data-signal terminals have different duty cycles, it is optionally to set different values for the turn-on voltage level or the turn-off voltage level so that the emission circuit can be tuned to operate at a current density that makes it working in maximum emission efficiency range to save power consumption of the circuit.

In a specific embodiment, when N=1, the method (of FIG. 6) is implemented as following for the pixel circuit of FIG. 3. The step of providing a gate-driving signal is executed as following: The first control signal provided in the control line D is set to a turn-on voltage level. When a gate-driving signal from the first gate line G1 is set to the turn-on voltage level, the first input transistor I1 is turned on. The control line D provides the first control signal in the turn-on voltage level through the first input transistor I1 to the first control node K1. When the gate-driving signal from the first gate line G1 is set to a turn-off voltage level, the first input transistor I1 is turned off and the level of the first control node K1 keeps the previous potential, since first control node K1 is coupled to the control circuit 20, especially to the latch subcircuit 201.

Further, the step of setting one switching node of the $2^N$ switching nodes to a turn-on voltage level is executed as following: When the first control node K1 is set to a turn-on voltage level, the third latch S3 controls the first switching node P1 to a turn-off voltage level and the third switching node P3 to the turn-on voltage level. The third output transistor T3 is turned on by the third switching node P3 at the turn-on voltage level, so that data signal from the third data-signal terminal V3 is inputted through the third output transistor T3 to the emission circuit 0. When the first control node K1 is set to a turn-off voltage level, the third latch controls the first switching node P1 to a turn-on voltage level and the third switching node P3 to the turn-off voltage level. The first output transistor T1 is turned on by the first switching node P1 being at the turn-on voltage level, so that data signal from the first data-signal terminal V1 is inputted through the first output transistor T1 to the emission circuit 0.

In another specific embodiment, when N=2, the method (of FIG. 6) is implemented as following for the pixel circuit of FIG. 4. The step of providing a gate-driving signal is executed as following: The first control signal from the control line D is provided with a turn-on voltage level. Other voltage levels at the first control node K1, the second control node K2, the gate-driving signal from the first gate line G1, and the gate-driving signal from the second gate line 02 are disclosed in FIG. 8. In particular, when the gate-driving signal from the first gate line G1 is set to a turn-on voltage level, the first input transistor I1 is turned on. The control line D then inputs the first control signal at the turn-on voltage level through the first input transistor I1 to the first control node K1. When the gate-driving signal from the first gate line G1 is set to a turn-off voltage level, the first input transistor I1 is turned off and the level of the first control node K1 keeps the previous potential, since first control node K1 is coupled to the control circuit 20, especially to the latch subcircuit 201.

When the gate-driving signal from the second gate line G2 is set to the turn-on voltage level, the second input transistor 12 is turned on. The control line D then inputs the first control signal at the turn-on voltage level via the second input transistor 12 to the second control node K2. When the gate-driving signal from the second gate line G2 is set to the turn-off voltage level, the second transistor 12 is turned off, and level of second control node K2 keeps the previous potential, since second control node K2 is coupled to the control circuit 20, especially to the latch subcircuit 201 and third control unit-circuit 2031.

In this operation, the voltage levels of the gate-driving signals from respective the first gate line G1 and the second gate line G2 may change with the time when a corresponding row of the pixels is scanned across the display panel. For example, for a row-scanning time period H, in the first H/2 time period, the gate-driving signal from the first gate line G1 may be a tur-on voltage level and the gate-driving signal from the second gate line G1 may be a turn-off voltage level; while in the second H/2 time period, the gate-driving signal from the first gate line G1 may be at the turn-off voltage level and the gate-driving signal from the second gate line G2 may be at the turn-on voltage level.

Further, the voltage levels associated with the latch node Q, the first switching node P1, the second switching node P2, the third switching node P3, and the fourth switching node P4 as well as a voltage level at a connection node F between the output circuit 30 and emission circuit 0, vary according to variations of the voltage levels of the first control node K1 and the second control node K2 are shown in Table 1. In the table, "0" represents a turn-off voltage level for any node and "1" represents a turn-on voltage level for any node. Table 1 is shown with an example in which the first control node K1 is set to the turn-off voltage level and the second control node K2 is set to the turn-on voltage level for executing the step of setting one switching node of the $2^N$ switching nodes to a turn-on voltage level of the method in FIG. 6.

TABLE 1

| K1 | K2 | P1 | P2 | P3 | P4 | Q | F |
|---|---|---|---|---|---|---|---|
| 0 | 0 | 0 | 0 | 1 | 0 | 1 | V3 |
| 0 | 1 | 0 | 0 | 0 | 1 | 1 | V4 |
| 1 | 0 | 1 | 0 | 0 | 0 | 0 | V1 |
| 1 | 1 | 0 | 1 | 0 | 0 | 0 | V2 |

When the first control node K1 is set to the turn-off voltage level and the second control node K2 is set to the turn-on voltage level, the third latch S3 is to control the latch node Q to a turn-on voltage level under control of the first control node K being set to the turn-off voltage level.

On the one hand, controlled by the latch node Q at the turn-on voltage level, the first latch S1 stops, and the first transistor M1 and the second transistor M2 are turned on by the latch node Q. The pull-down power supply VSS now inputs a pull-down voltage signal (at the turn-off voltage level) through the first transistor M1 to the first switching node P1 to set the turn-off voltage level to the first switching node P1, making the first output transistor T1 to be turned off. At the same time, the pull-down power supply VSS also inputs the turn-off voltage level through the second transistor M2 to the second switching node P2, making the second output transistor M2 to be turned off. In this case, although the second switching node P2 is connected to the second control node K2, but by setting proper channel width-to-length ratios respectively for the first transistor M1 and the second transistor M2, the second switching node P2 can be maintained to be the same as the pull-down voltage signal (i.e., at the turn-off voltage level) when both the first transistor M1 and the second transistor M2 are turned on.

On the other hand, controlled by the first control node K1 at the turn-off voltage level, the second latch S2 operates, and third tri-state gate S21 in the second latch S2 controls the third switching node P3 to the turn-off voltage level under control of the second control node K2 at the turn-on voltage level. The third output transistor T3 is turned off under control of the third switching node P3 at the turn-off voltage level so as to further turn off both the third transistor M3 and the fourth transistor M4 under control the first control node K1 being at the turn-off voltage level. At this time, the fourth switching node P4 is set to a same voltage level of the second control node K2, i.e., at the turn-on voltage level. The fourth output transistor T4 is turned on, so that the fourth data-signal terminal V4 inputs the data signal from V4 through the fourth output transistor T4 to the emission circuit 0, providing the data signal needed to drive light emission.

As shown above, the method of driving the pixel circuit can be implemented to use voltage levels at the first control node K1 and the second control node K2 to control one of the four switching nodes to be at the turn-on voltage level so that at one time only one data-signal terminal V can supply a data signal to the emission circuit, ensuring that the emission circuit to emit light normally.

In yet another aspect, the present disclosure provides a pixel unit. Referring to one of FIG. 1 through FIG. 5, the pixel unit includes an emission circuit 0 and a pixel circuit 1 described herein. The pixel circuit 1 includes at least one output circuit coupled to the emission circuit 0.

Figure 9:
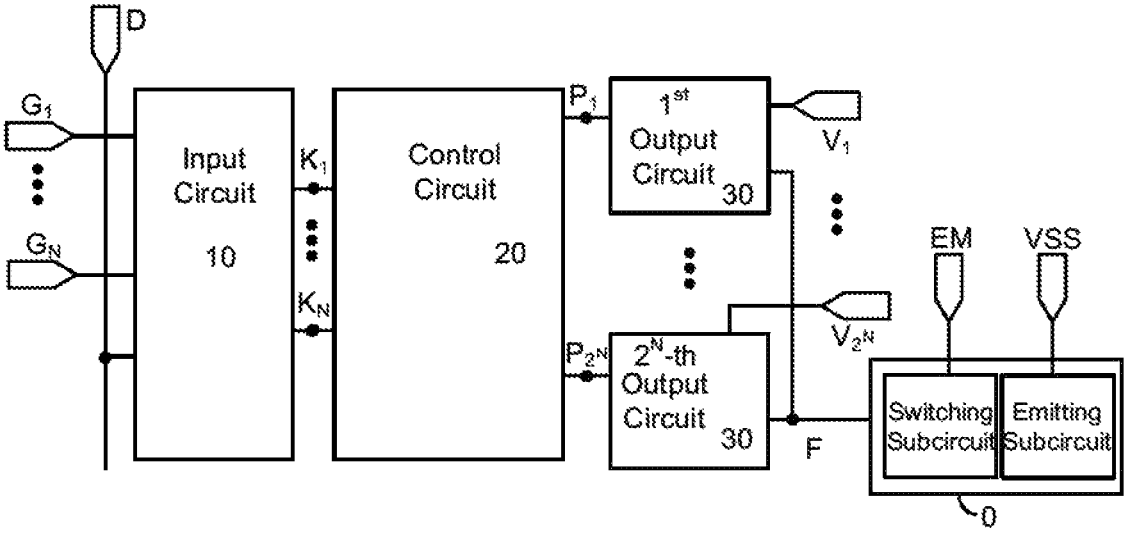
FIG. 9 is a block diagram of an emission circuit according to an embodiment of the present disclosure.

Optionally, the emission circuit 0 is configured to have an emitting subcircuit 02 and other subcircuits for controlling the emitting subcircuit 02. The emission circuit 0 and other subcircuits can be set in many ways. Yet, some examples are disclosed here. In an embodiment, FIG. 9 is a block diagram of an emission circuit according to an embodiment of the present disclosure. Referring to FIG. 9, the emission circuit 0 includes a switching subcircuit 01 and an emitting subcircuit 02. The switching subcircuit 01 is connected respectively to a second control terminal EM, the emitting subcircuit 02, and an output circuit 30 of the pixel circuit described herein. The switching subcircuit 01 is configured to input a signal coming from the output circuit 30 under control of a second control signal provided to the second control terminal EM. The emitting subcircuit 02 is connected respectively to the switching subcircuit 01 and a pull-down power supply VSS. The switching subcircuit 01 inputs a signal coming from the output circuit 30 to the emitting subcircuit 02 to provide an anode voltage needed for the emitting subcircuit 02 to emit light. The pull-down power supply VSS provides a cathode voltage needed for the emitting subcircuit 02 to emit light.

Figure 8:
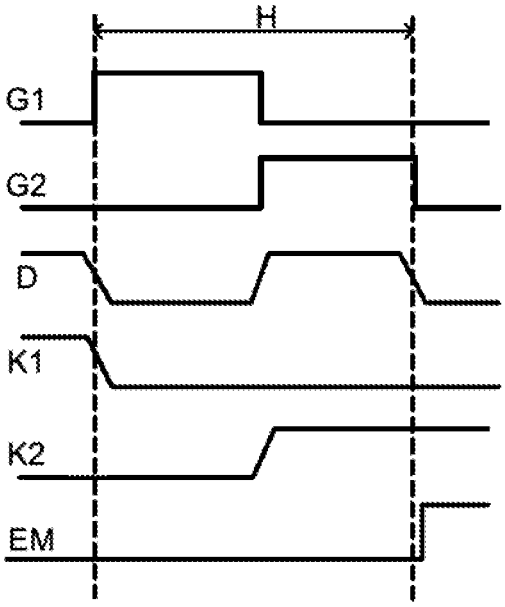
FIG. 8 is a schematic diagram of voltage levels for the first control node, the second control node, a gate-driving signal from a first gate line, and a gate-driving signal from a second gate line according to an embodiment of the present disclosure.
Figure 10:
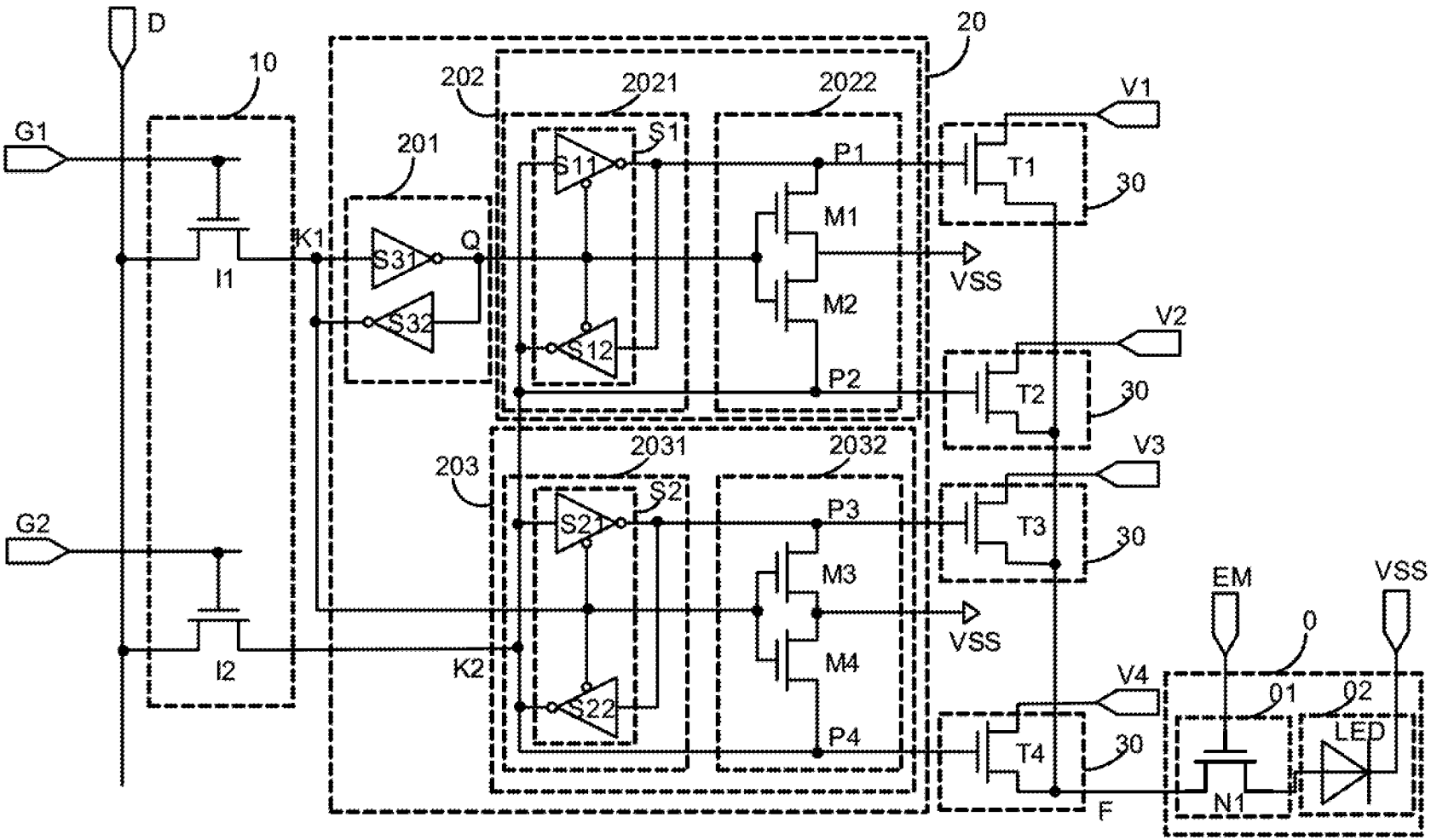
FIG. 10 is a schematic diagram of an emission circuit coupled to the pixel circuit of FIG. 5 according to a specific embodiment of the present disclosure.

Optionally, the switching subcircuit 01 is formed by transistors. Optionally, the emitting subcircuit 02 is formed with Micro LED. FIG. 10 shows a schematic diagram of an emission circuit coupled to the pixel circuit of FIG. 5 according to a specific embodiment of the present disclosure. The switching subcircuit 01 includes a switching transistor N1. The switching transistor N1 has a gate terminal connected to a second control terminal EM, a first terminal connected to the output circuit 30, and a second terminal connected to an anode of a Micro LED. The Micro LED has a cathode connected to the pull-down power supply VSS. Referring to FIG. 8, FIG. 9, and FIG. 10, the second control signal from the second control terminal EM is set to be in effective turn-on voltage level with slightly delayed timing after all gate-driving signals $G_n$ finish their scans as signals at effective turn-on voltage level to ensure that that the Micro LED receives accurate anode voltage to drive its light emission.

Figure 11:
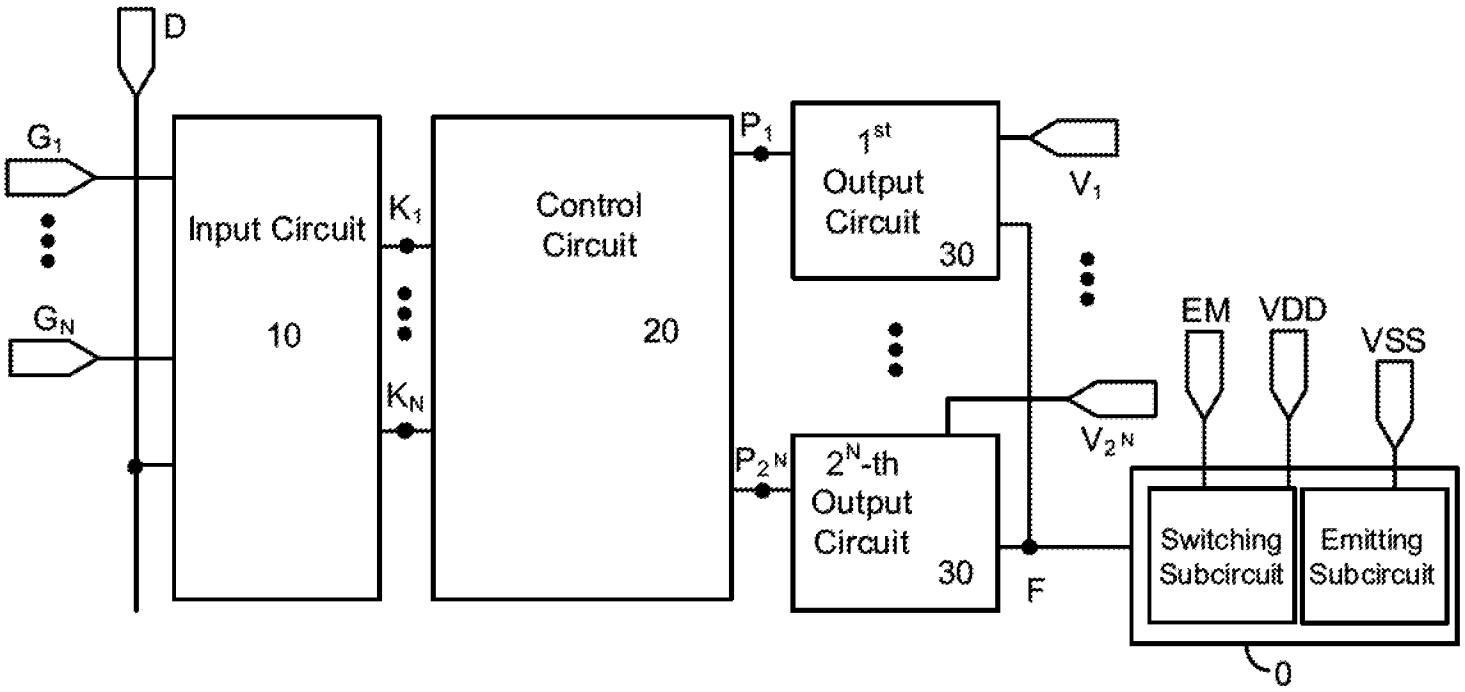
FIG. 11 is a block diagram of an emission circuit according to another embodiment of the present disclosure.

In another embodiment, FIG. 11 is a block diagram of an emission circuit coupled to the pixel circuit of FIG. 5 according to another embodiment of the present disclosure. The emission circuit 0 includes a switching subcircuit 01 and an emitting subcircuit 02. The switching subcircuit 01 is connected respectively to a second control terminal EM, a pull-up power supply VDD, an output circuit 30, and the emitting subcircuit 02. The switching subcircuit 01 is configured, under control of a second control signal from the second control terminal EM and a signal from the output circuit 30, to input a pull-up voltage signal from the pull-up power supply VDD to the emitting subcircuit 02.

Optionally, the emitting subcircuit 02 is connected respectively with the switching subcircuit 01 and a pull-down power supply VSS. The switching subcircuit 01 provides the pull-up voltage signal to the emitting subcircuit 02 as an anode voltage needed for the emitting subcircuit 02 to emit light. The pull-down power supply VSS is to provide a cathode voltage needed for the emitting subcircuit 02 to emit light.

Figure 12:
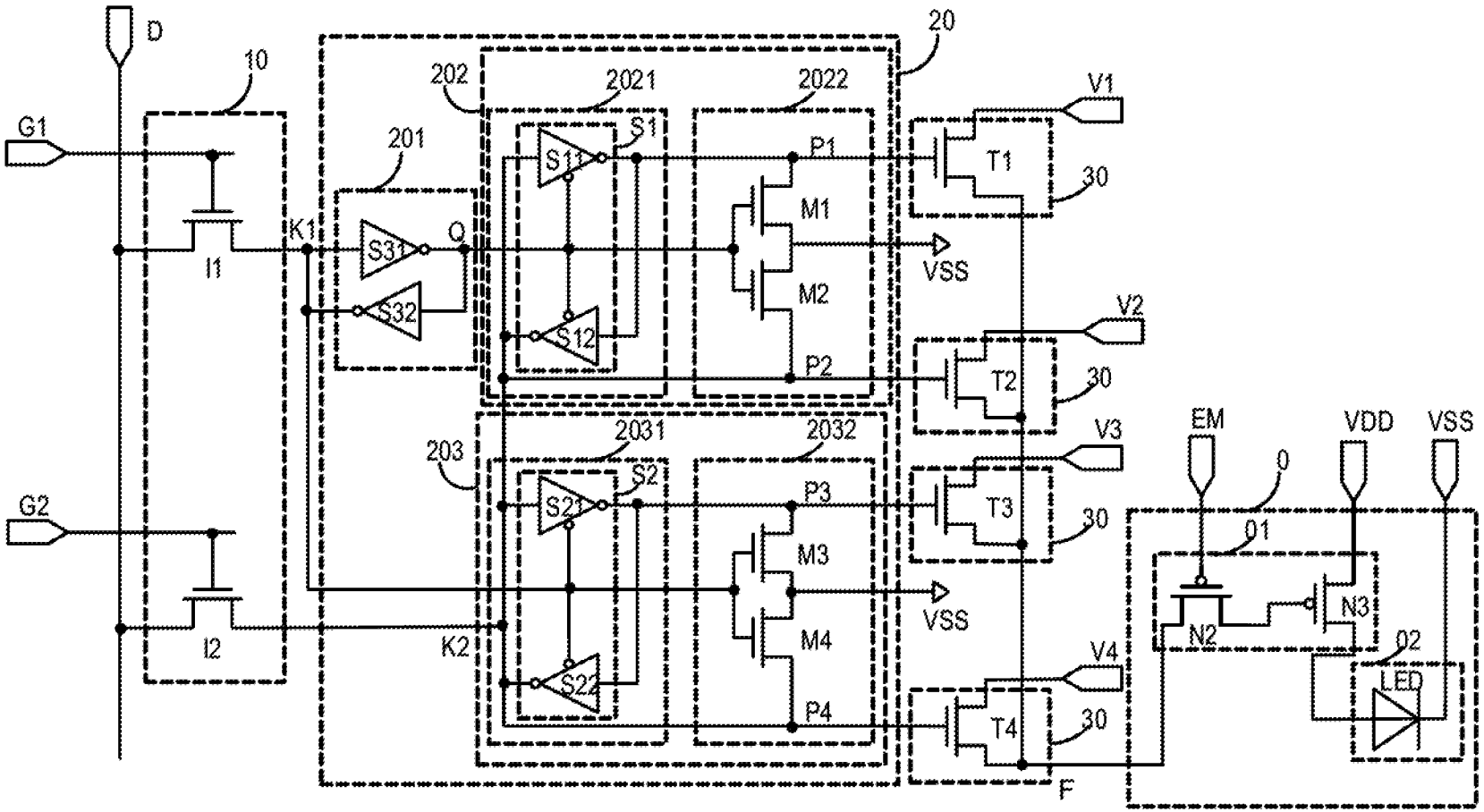
FIG. 12 is a schematic diagram of an emission circuit according to another embodiment of the present disclosure.

Optionally, the switching subcircuit 01 is formed with transistors. The emitting subcircuit 02 is formed with a Micro LED. FIG. 12 shows a schematic diagram of an emission circuit coupled to the pixel circuit of FIG. 5 according to still another embodiment of the present disclosure. Here N=2. The switching subcircuit 01 includes a first switching transistor N2 and a second switching transistor N3. The first switching transistor N2 has a gate terminal connected to the second control terminal EM, a first terminal connected to the output circuit 30, and a second terminal connected to a gate terminal of the second switching transistor N3. The second switching transistor N3 also has a first terminal connected to the pull-up power supply VDD and a second terminal connected to an anode of a Micro LED. The Micro LED has a cathode connected to the pull-down power supply VSS. Optionally, the first switching transistor N2 and the second switching transistor N3 are P-type transistors.

In the embodiment above with the emission circuit as configured in FIG. 12, when the data signals from the $2^N$ numbers of data-signal terminals have different duty cycles, different one of $2^N$ output circuits 30 can be used to provide a different data signal with a different duty cycle so that a time duration to make the second switching transistor in conduction state can be controlled, which in turn controls the time duration for the emitting subcircuit 02 to emit light. Based on integral effect of human vision, the longer of a light emission, the brighter the brightness perceived by the human eye. Therefore, by controlling the emission time duration of the emitting subcircuit 02, different brightness levels can be perceived by human eye so that effectively the pixel unit can produce different up to $2^N$, grayscale levels in display.

Figure 13:
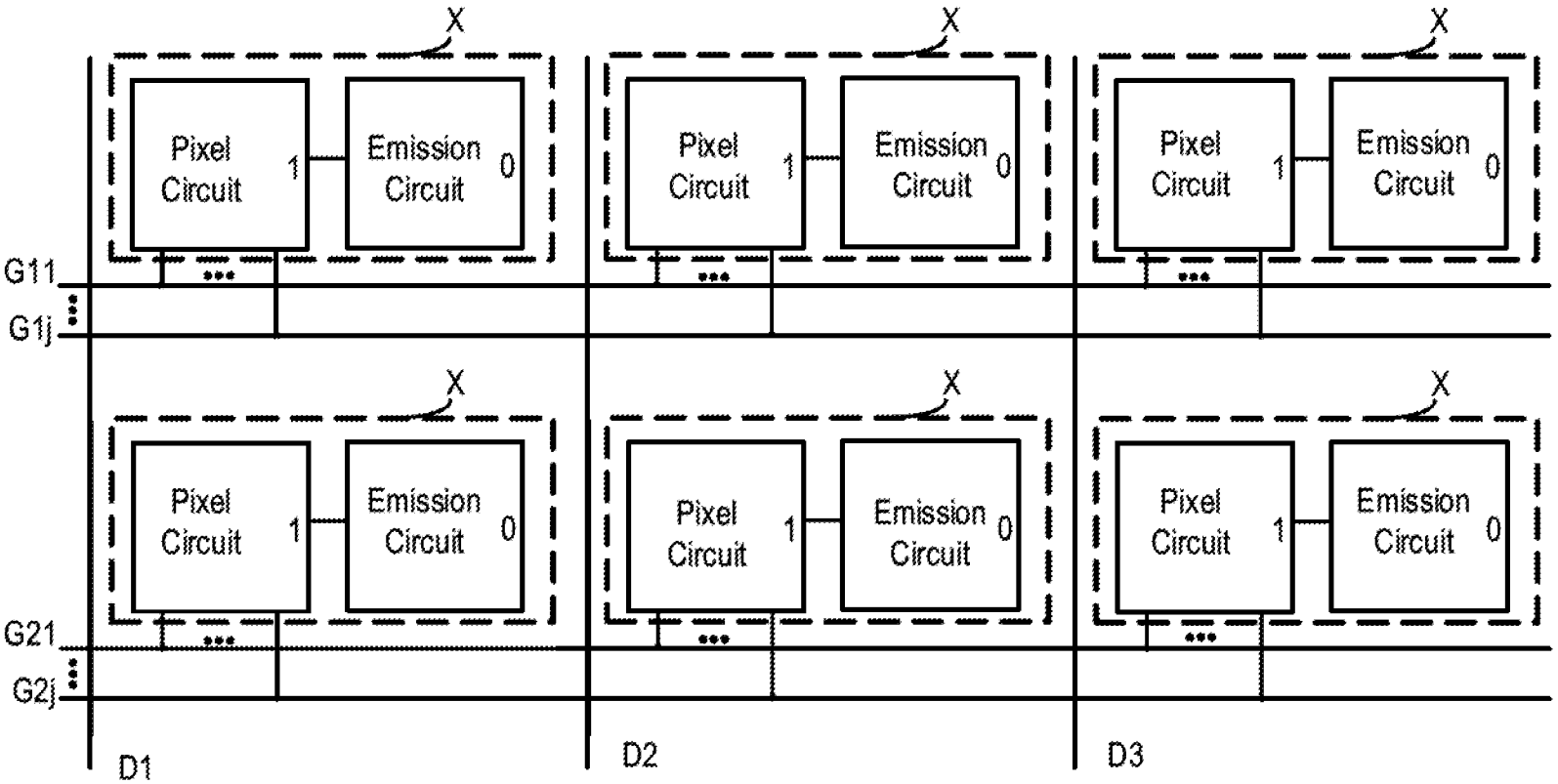
FIG. 13 is a schematic diagram of a display panel according to an embodiment of the present disclosure.

In yet another aspect, the present disclosure provides a display panel including a plurality of pixel units. Optionally, the plurality of pixel units is arranged in an array with multiple rows and multiple columns. FIG. 13 is a schematic diagram of a display panel according to an embodiment of the present disclosure. Referring to FIG. 13, the display panel includes multiple gate lines (for example, gate lines G11 through G1*j*, and gate lines G21 through G2*j*), multiple control lines (for example, D1, D2, and D3), and multiple pixel units X formed by crossing the gate lines G and control lines D. The multiple pixel units are arranged in an array. Each pixel unit X in the array includes a pixel circuit 1 and an emission circuit 0. The pixel circuit 1 can be any one described above as shown in FIG. 1 through FIG. 5. The emission circuit 0 can be any one described above as shown in FIG. 9 through FIG. 12.

In yet still another aspect, the present disclosure provides a display apparatus. The display apparatus includes the display panel described herein. The display apparatus can be selected from one of a smart watch, a flat panel display, a electronic paper, a smart phone, a tablet computer, a television, a displayer, a notebook computer, a digital picture frame, a navigator, and any product or component having a display function.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A pixel circuit comprising:

an input circuit respectively connected with N gate lines, a control line, and N control nodes, the input circuit being configured to control voltage levels of the N control nodes under control of a respective one gate-driving signal from a respective one of the N gate lines and under control of a first control signal from the control line;

a control circuit respectively connected with the N control nodes and $2^N$ switching nodes, the control circuit being configured to control a voltage level of a respective one of the $2^N$ switching nodes under control of the N control nodes; and $2^N$ output circuits respectively connected with $2^N$ data-signal terminals, the $2^N$ output circuits being connected with the $2^N$ switching nodes, wherein an i-th output circuit of the $2^N$ output circuits is coupled respectively with an i-th switching node of the $2^N$ switching nodes, an i-th data-signal terminal of the $2^N$ data-signal terminals, and an emission circuit, the i-th output circuit being configured to output an i-th data signal from the i-th data-signal terminal under control of the i-th switching node, wherein N is a positive integer, i is a positive integer no greater than N;

wherein the N is 2; the control circuit includes a latch subcircuit, a first control subcircuit, and a second control subcircuit; the $2^N$ switching nodes include a first switching node, a second switching node, a third switching node, and a fourth switching node; the N control nodes include a first control node and a second control node;

the latch subcircuit being connected respectively to the first control node and a latch node configured to set a voltage level thereof under control of the first control node;

the first control subcircuit being connected respectively to the latch node, the second control node, the first switching node, and a second switching node, the first control subcircuit being configured to respectively set voltage levels of the first switching node and the second switching node under control of the latch node and the second control node;

the second control subcircuit being connected respectively to the first control node, the second control node, the third switching node, and the fourth switching node, the second control subcircuit being configured to respectively set voltage levels of the third switching node and the fourth switching node under control of the first control node and the second control node.

2. The pixel circuit of claim 1, wherein the first control subcircuit comprises a first control unit-circuit and a second control unit-circuit; the second control subcircuit comprises a third control unit-circuit and a fourth control unit-circuit;

the first control unit-circuit being connected respectively to the latch node, the second control node, the first switching node, and the second switching node, and being configured to respectively set voltage levels of the first switching node and the second switching node under control of the latch node and the second control node;

the second control unit-circuit being connected respectively to the latch node, a pull-down power supply, the first switching node, and the second switching node, and being configured to respectively set voltage levels of the first switching node and the second switching node under control of a pull-down voltage from the pull-down power supply;

the third control unit-circuit being connected respectively to the first control node, the second control node, the third switching node, and the fourth switching node, and being configured to respectively set voltage levels of the third switching node and the fourth switching node under control of the first control node and the second control node;

the fourth control unit-circuit being connected respectively to the first control node, the pull-down power supply, the third switching node, and the fourth switching node, and being configured to respectively set voltage levels of the third switching node and the fourth switching node under control of the first control node and the pull-down voltage.

3. The pixel circuit of claim 2, wherein the first control unit-circuit comprises a first latch having an input terminal connected to the second control node and an output terminal connected to the first switching node;

the third control unit-circuit comprises a second latch having an input terminal connected to the second control node and an output terminal connected to the third control node.

4. The pixel circuit of claim 3, wherein the first latch comprises a first tri-state gate and a second tri-stage gate, the second latch comprises a third tri-state gate and a fourth tri-state gate;

the first tri-state gate comprising a control terminal connected to the latch node, an input terminal connected to the second control node, and an output terminal connected to the first switching node;

the second tri-state gate comprising a control terminal connected to the latch node, an input terminal connected to the first switching node, and an output terminal connected to the second control node;

the third tri-state gate comprising a control terminal connected to the first control node, an input terminal connected to the second control node, and an output terminal connected to the third switching node; and the fourth tri-state gate comprising a control terminal connected to the first control node, an input terminal connected to the third switching node, and an output terminal connected to the second control node.

5. The pixel circuit of claim 2, wherein the second control unit-circuit comprises a first transistor and a second transistor; the fourth control unit-circuit comprises a third transistor and a fourth transistor;

the first transistor having a gate terminal connected to the latch node, a first terminal connected to the pull-down power supply, and a second terminal connected to the first switching node;

the second transistor having a gate terminal connected to the latch node, a first terminal connected to the pull-down power supply, and a second terminal connected to the second switching node;

the third transistor having a gate terminal connected to the first control node, a first terminal connected to the pull-down power supply, and a second terminal connected to the third switching node; and the fourth transistor having a gate terminal connected to the first control node, a first terminal connected to the pull-down power supply, and a second terminal connected to the fourth switching node.

6. The pixel circuit of claim 1, wherein the latch subcircuit comprises a third latch having an input terminal connected to the first control node and an output terminal connected to the latch node.

7. The pixel circuit of claim 6, wherein the third latch comprises a first non-gate and a second non-gate;

the first non-gate having an input terminal connected to the first control node and an output terminal connected to the latch node; and the second non-gate having an input terminal connected to the latch node and an output terminal connected to the first control node.

8. The pixel circuit of claim 1, wherein the N is 1, the $2^N$ switching nodes includes a first switching node and a third switching node, the N control node is a first control node; the control circuit being connected respectively to the first control node, the first switching node, and the third switching node, and being configured to set voltage levels of the first switching node and the third switching node under control of the first control node.

9. The pixel circuit of claim 1, wherein the i-th output circuit comprises an i-th output transistor having a gate terminal connected to the i-th switching node, a first terminal connected to the i-th data-signal terminal, and a second terminal connected to the emission circuit.

10. The pixel circuit of claim 1, wherein the input circuit comprises N input transistors among which a j-th input transistor having a gate terminal connected to a j-th gate line, a first terminal connected to the control line, and a second terminal connected to a j-th control node, wherein j is a positive integer no greater than N.

11. A driving method of a pixel circuit of claim 1, comprising:

providing a gate-driving signal at a turn-on voltage level to a j-th gate line of the N gate lines so that the input circuit transports a first control signal in the control line to a corresponding j-th control node of the N control nodes, wherein j is a positive integer no greater than N;

setting one switching node of the $2^N$ switching nodes to a turn-on voltage level under control of the N control nodes so that a corresponding one output circuit connected to the one switching node is to input a data signal from a corresponding data-signal terminal connected to the corresponding one output circuit to the emission circuit, wherein the $2^N$ output circuits are connected respectively to the $2^N$ switching nodes, the $2^N$ output circuits are connected respectively to $2^N$ data-signal terminals, the $2^N$ data-signal terminals supply different data signals.

12. The method of claim 11, wherein the $2^N$ data-signal terminals supply different data signals with different amplitudes.

13. The method of claim 11, wherein the $2^N$ data-signal terminals supply different data signals with different duty cycles.

14. The method of claim 11, wherein the N is 2, the control circuit includes a latch subcircuit, a first control subcircuit, and a second control subcircuit; the $2^N$ switching nodes includes a first switching node, a second switching node, a third switching node, and a fourth switching node; the N control nodes includes a first control node and a second control node; the method comprising:

setting the first control node at a turn-off voltage level and the second control node at a turn-off voltage level, so that the control circuit sets the first switching node to the turn-off voltage level, the second switching node to the turn-off voltage level, the third switching node to a turn-on voltage level, and the fourth switching node to the turn-off voltage level;

setting the first control node at a turn-off voltage level and the second control node at a turn-on voltage level, so that the control circuit sets the first switching node to the turn-off voltage level, the second switching node to the turn-off voltage level, the third switching node to the turn-off voltage level, and the fourth switching node to the turn-on voltage level;

setting the first control node at a turn-on voltage level and the second control node at a turn-off voltage level, so that the control circuit sets the first switching node to the turn-on voltage level, the second switching node to the turn-off voltage level, the third switching node to the turn-off voltage level, and the fourth switching node to the turn-off voltage level; and setting the first control node at a turn-on voltage level and the second control node at the turn-on voltage level, so that the control circuit sets the first switching node to a turn-off voltage level, the second switching node to the turn-on voltage level, the third switching node to the turn-off voltage level, and the fourth switching node to the turn-off voltage level.

15. The method of claim 11, wherein the N is 1, the $2^N$ switching nodes includes a first switching node and a third switching node, the N control node is a first control node; the method comprising:

setting the first control node to a turn-on voltage level, so that the control circuit sets the first switching node to a turn-off voltage level and the third switching node to the turn-on voltage level; and setting the first control node to a turn-off voltage level, so that the control circuit sets the first switching node to a turn-on voltage level and the third switching node to the turn-off voltage level.

16. A pixel unit comprising an emission circuit and a pixel circuit of claim 1, wherein the pixel circuit comprises an output circuit coupled to the emission circuit.

17. The pixel unit of claim 16, wherein the emission circuit comprises a switching subcircuit and an emitting subcircuit; the switching subcircuit being connected respectively to a second control-signal terminal, the output circuit being connected to the emitting subcircuit, the switching subcircuit being configured to input a signal from the output circuit to the emitting subcircuit under control of a second control signal from the second control-signal terminal.

18. The pixel unit of claim 16, wherein the emission circuit comprises a switching subcircuit and an emitting subcircuit; the switching subcircuit being connected respectively to a second control-signal terminal, a pull-up power supply, the output circuit, and the emitting subcircuit, the switching subcircuit being configured to input a pull-up voltage signal from the pull-up power supply to the emitting subcircuit under control of a second control signal from the second control-signal terminal.

19. A display panel comprising a plurality of pixel units, each of the plurality of pixel units being the pixel unit of claim 16.

* * * * *